United States Patent [19]

Olszewski et al.

[11] 4,224,045

[45] Sep. 23, 1980

[54] CRYOGENIC SYSTEM FOR PRODUCING LOW-PURITY OXYGEN

[75] Inventors: Walter J. Olszewski, Tonawanda; John H. Ziemer, Grand Island, both of N.Y.

[73] Assignee: Union Carbide Corporation, New York, N.Y.

[21] Appl. No.: 936,093

[22] Filed: Aug. 23, 1978

[51] Int. Cl.[2] ..... F25J 3/04

[52] U.S. Cl. ..... 62/30; 60/39.55; 62/38

[58] Field of Search ..... 62/135, 29, 30; 60/39.55, 39.18 R

[56] References Cited

U.S. PATENT DOCUMENTS

| | | | |
|---|---|---|---|
| 2,520,862 | 8/1950 | Swearingen | 62/29 |
| 3,605,422 | 9/1971 | Pryor et al. | 62/13 |
| 3,693,347 | 5/1971 | Kydd et al. | 60/39.55 |
| 3,731,495 | 5/1973 | Coveney | 62/29 |
| 3,982,878 | 10/1975 | Yamane et al. | 60/39.55 |

*Primary Examiner*—Norman Yudkoff

*Attorney, Agent, or Firm*—Steven J. Hultquist

[57] ABSTRACT

Low-purity oxygen is produced by fractional distillation of liquefied air. A gas turbine, powered in part by waste nitrogen from the distillation, supplies energy to compress the feed air. Compressing the waste nitrogen prior to turbine expansion provides an increase in energy efficiency.

22 Claims, 7 Drawing Figures

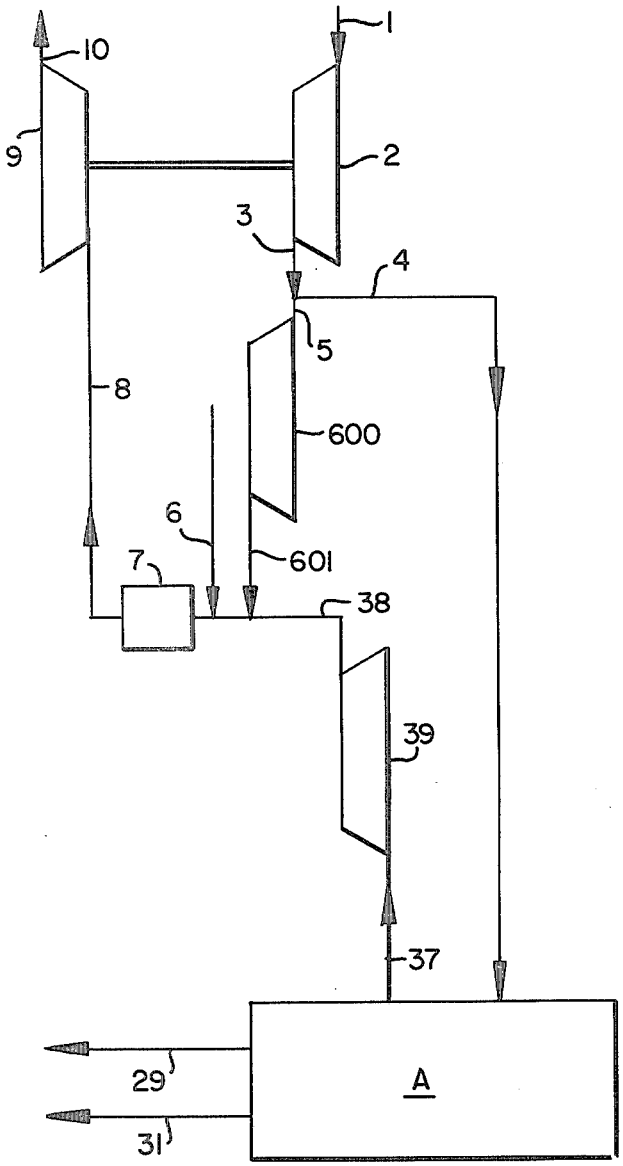
FIG. 6
FIG. 7
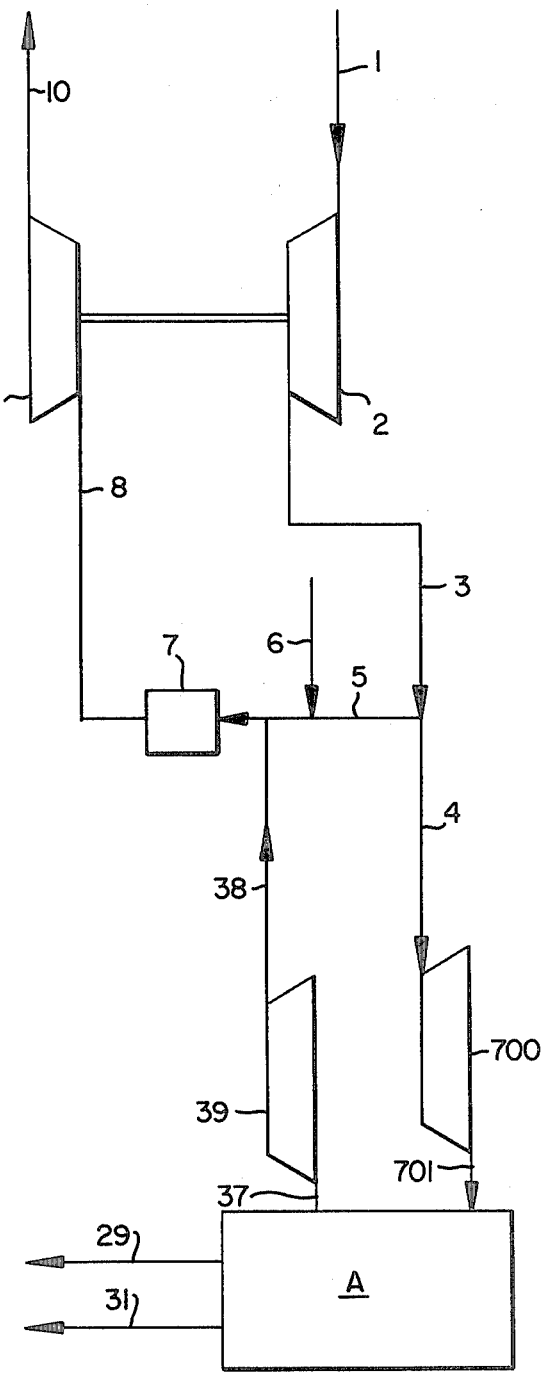

CRYOGENIC SYSTEM FOR PRODUCING LOW-PURITY OXYGEN

BACKGROUND

This invention relates to the low-temperature fractionation of air to obtain low-purity oxygen and nitrogen-rich products. The term "low-purity-oxygen" as used throughout the present specification and claims is intended to mean a product having an oxygen content of less than 99.5 mole percent.

It is believed that very large quantities of low-purity oxygen will be required by processes now being developed for converting coal to liquid or gaseous products. Another use for low-purity oxygen is in a process for converting refuse to useful gaseous products as described in Anderson, U.S. Pat. No. 3,729,298. Hence, a process for producing low-purity oxygen in large quantities at low cost is desirable.

A common system for low temperature fractionation employs a higher-pressure rectification column having its upper end in heat exchange relation with the lower end of a lower-pressure rectification column. Cold compressed air is separated into oxygen-enriched and nitrogen-rich liquids in the higher-pressure column, and these liquids are transferred to the lower-pressure column for separation into nitrogen-rich and oxygen-rich products. Examples of this double-column distillation system appear in Ruheman's "The Separation of Gases," Oxford University Press, 1945.

Large quantities of energy are required to compress the feed air for such a process. Hence, in these times of rising energy cost, a saving of energy is important. Coveney, in U.S. Pat. No. 3,731,495, discloses a system for reducing the energy required by the double-column distillation system by use of a nitrogen-quenched power turbine. A portion of the compressed feed air is mixed with fuel and combusted. The hot combustion mixture is then quenched with waste nitrogen-rich gas from the lower-pressure column, and the resulting gaseous mixture is expanded in a power turbine. The expansion provides energy to compress the feed air to the system. A disadvantage of the Coveney process is that the pressure of the gaseous mixture expanded in the power turbine can be no higher than that of the waste nitrogen mixed with the combustion gases. Hence, it would be impossible, in the Coveney process, to operate both lower pressure column and turbine at their respective optimum pressures, unless both had the same optimum pressure. However, it has been found that commercially available power turbines usually have optimum inlet pressures exceeding the optimum operating pressure of the lower-pressure rectification column in a typical air-separating system. This is true even for most of the higher-than-normal pressures used in the lower-pressure rectification column of the Coveney process. Hence, Coveney's invention is unable to achieve optimum operation of both the distillation system and the power turbine.

Another cryogenic air-separation system using a power turbine is disclosed by Swearingen, in U.S. Pat. No. 2,520,862. The Swearingen process mixes waste nitrogen-rich gas obtained from the higher-pressure column with a portion of compressed feed air. Fuel is then injected into the mixture, and the mixture is combusted and expanded in a power turbine, thereby providing energy to compress the feed air for the system. Like the Coveney process, Swearingen's process requires that the pressure of the gaseous mixture expanded in the power turbine be no greater than that of the nitrogen mixed with the combustion mixture. Hence, Swearingen is also unable to independently set the pressure of the turbine inert gas and higher pressure column to achieve optimum operation of both the power turbine and the distillation system. Swearingen, has a further disadvantage in that the nitrogen stream removed from the higher-pressure rectification column is unavailable for feeding to the lower-pressure rectification column, thereby depriving that column of reflux in proportion to the amount of nitrogen removed from the higher-pressure stage.

OBJECTS

Accordingly, it is an object of this invention to cryogenically produce low-purity oxygen from air using a double-column distillation system and a nitrogen-quenched power turbine in such manner that either the distillation system or power turbine can operate at least 20 psi closer to its optimum pressure.

It is another object of this invention to cryogenically produce low purity oxygen using a double column distillation system and a nitrogen quenched power turbine in such manner that both the distillation system and power turbine can operate substantially at their respective optimum pressures.

It is a further object of the invention to cryogenically produce low-purity oxygen from air using a double-column distillation system and a nitrogen-quenched power turbine with reduced energy requirements.

SUMMARY OF THE INVENTION

These and other objects are achieved by the present invention one aspect of which comprises:

a process for producing low-purity oxygen by low-temperature rectification of air comprising:

(a) compressing feed air to at least 85 psia, (b) dividing the compressed air into a first part and second part, (c) mixing said first part as oxidant for a combustion stream with fuel, (d) igniting said combustion stream in a combustion zone at ignition pressure of at least 80 psia to heat said combustion stream, (e) expanding the heated combustion stream in a power turbine to lower pressure with the production of external work, (f) recovering at least part of said external work as energy for said compressing of feed air, (g) cooling said second part of compressed air, (h) introducing the cooled air to a higher pressure rectification stage having its upper end in heat exchange relation with the lower end of a lower pressure rectification stage, (i) separating said cooled air into oxygen-enriched and nitrogen-rich liquids in said higher pressure rectification stage, (j) transferring at least part of said liquids from step (i) to said lower pressure rectification stage for separation into low purity oxygen and nitrogen-rich gases.

(k) operating said lower-pressure rectification stage at pressure at least 20 psi lower than the step (d) ignition pressure.

(l) discharging a low-purity oxygen product stream and at least one nitrogen-rich gas stream from said lower pressure rectification stage, (m) compressing at least part of the nitrogen-rich gas discharged in step (l) to pressure at least equal to the step (d) ignition pressure, and (n) flowing the compressed nitrogen-rich stream into the combustion stream, upstream of said power turbine.

Another aspect of the invention comprises:

apparatus for producing low-purity oxygen by low temperature rectification comprising:

(a) a compressor for compressing feed air to pressure of at least 85 psia, (b) a combustion system comprising a combustion chamber, conduit means for flowing a first part of compressed feed air from compressor (a) to said combustion chamber, means for introducing fuel to said combustion chamber, and conduit means for flowing combusted gas from said combustion chamber to, (c) a turbine for expanding the combusted gas to lower pressure so as to produce external work, (d) means for transferring external work of turbine (c) to compressor (a), (e) means for cooling a second part of compressed feed air, (f) a double rectification column comprising a higher-pressure stage for operation at at least about 85 psia, a lower-pressure stage, and a heat exchanger joining the upper end of the higher-pressure stage and the lower end of the lower-pressure stage, separate conduit means for transferring oxygen-enriched and nitrogen-rich liquids from the higher-pressure stage to the lower-pressure stage, (g) conduit means for flowing the cooled cleaned second part of the compressed feed air to the higher-pressure stage for rectification therein, (h) a compressor for compressing nitrogen-rich gas to pressure of at least 85 psia, (i) conduit means for flowing nitrogen-rich gas from the lower-pressure rectification stage to compressor (h), (j) conduit means for flowing nitrogen-rich gas from compressor (h) to combustion system (b), and (k) conduit means for discharging low-purity oxygen from said lower-pressure rectification stage.

This invention is predicated on the finding that performing the seemingly inefficient step of boosting the pressures of the nitrogen-rich gas prior to injecting it into the combustion stream for expansion in the power turbine substantially increases in the total energy efficiency of the process. One would expect that compressing the nitrogen-rich stream, only to expand it again, would cause a net loss of energy efficiency, since the compression process, which must be performed at less than 100 percent energy efficiency, would seem to be a wasteful intermediate step. However, it has been found that the inefficiency of performing the extra nitrogen compression step is more than compensated for by the gain in efficiency of being able to operate either the power turbine or the air separation system closer to its optimum pressure. By compressing the nitrogen-rich gas stream to a pressure approximating the optimum inlet pressure of the power turbine, the entire combustion system can also operate at that pressure, and the gaseous stream expanded in the power turbine can be at the turbine's optimum inlet pressure.

The term "cooling" as used throughout the present specification and claims is intended to mean cooling a stream to near its dew point. A preferred method of cooling the air fed to the double-column distillation system is by heat exchange with cold products of the distillation system in a reversing heat exchanger well known in the art. The cooling step also removes high-boiling impurities, such as water and carbon dioxide from the feed air.

The term "efficiency" as used throughout the present specification and claims with regard to a power turbine is intended to mean the ratio of the turbine shaft work output to fuel heat input.

The term "optimum inlet pressure", as used throughout the present specification and claims is intended to mean the inlet pressure at which a power turbine attains its maximum efficiency for a given set of inlet conditions other than pressure.

The term "optimum operating pressure" as used throughout the present specification and claims is intended to mean the operating pressure of a rectification stage for which the air-separation system's energy requirements are a minimum for a given oxygen product stream delivery pressure.

The term "product stream" as used throughout the present specification and claims is intended to mean a stream separated in the air-separation column and removed from the air-separation system that is not mixed with the first part of compressed air and expanded in the power turbine.

As used herein, all percent compositions refer to mole percents.

The preferred percent oxygen of the low-purity oxygen product is above 90 percent with between 95 and 99.5 percent being most preferred.

IN THE DRAWINGS

FIG. 6 is a schematic flowsheet of an embodiment of the invention wherein the first part of the compressed feed air is further compressed prior to entering the combustion zone.

FIG. 7 is a schematic flowsheet of an embodiment of the invention wherein the air fed to the air separation system is work expanded after the first part is split off for the combustion system.

DETAILED DESCRIPTION OF THE INVENTION

Figure 1:
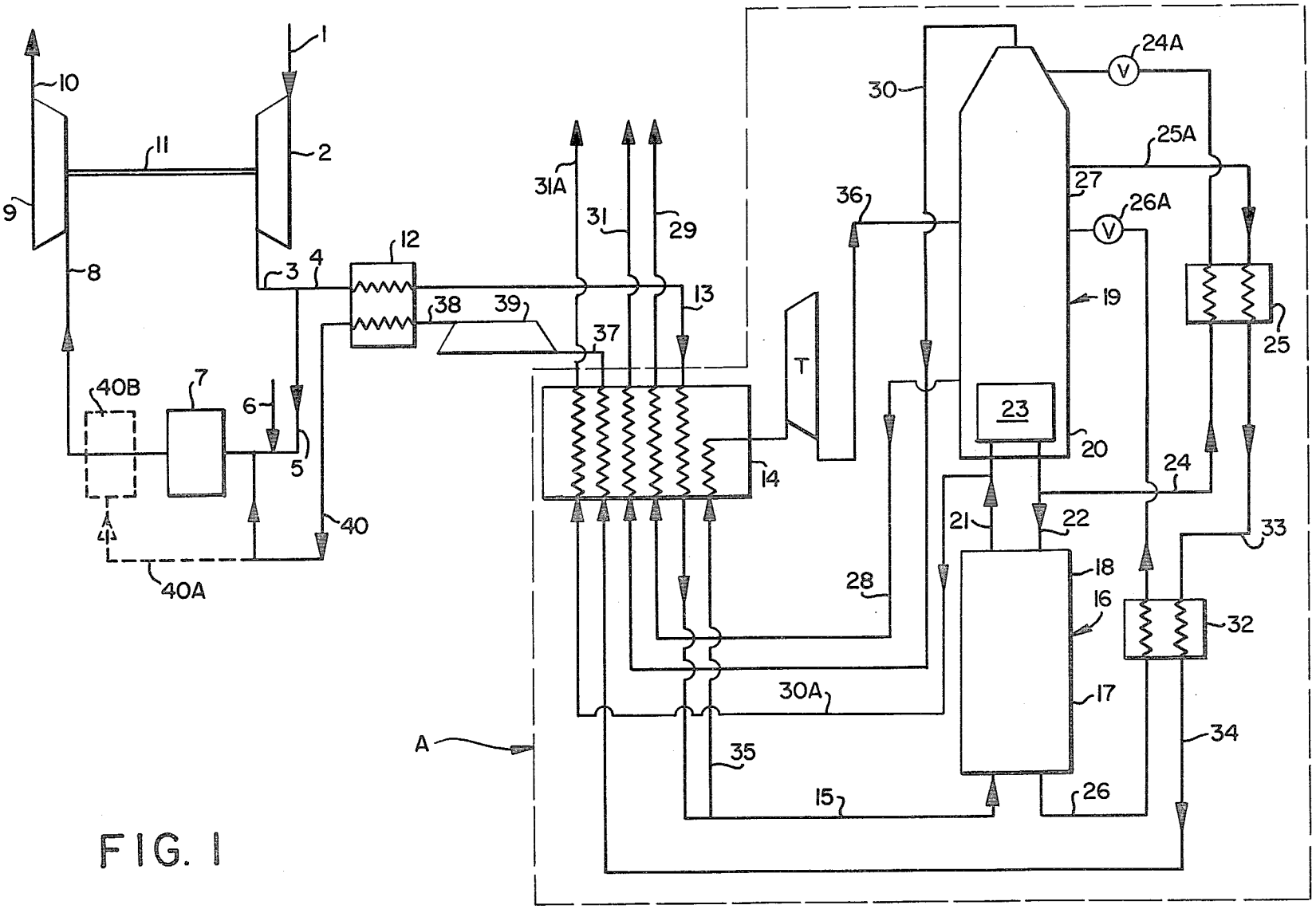
FIG. 1 is a schematic flowsheet of a complete system for producing low-purity oxygen in accordance with a preferred embodiment of the invention.

Referring now to FIG. 1, this embodiment of the invention comprises an air-separation system, A, enclosed by dotted lines, and a power system, drawn outside the dotted lines. The system functions as follows. Feed air enters base compressor 2 by conduit 1 and is compressed to a pressure of at least 85 psia, and preferably to between 100 and 250 psia. After flowing from compressor 2 in conduit 3, the compressed feed air is divided into a first part in conduit 5 and a second part in conduit 4. The handling of the second part, which is fed to the air separation system, will be described later. The first part of the compressed feed air is used to form a combustion stream. The term "combustion stream" as used throughout the present specification and claims is intended to refer to the gas flowing from the point where the first part of the compressed feed air is split from the second part to the inlet of the power turbine. In FIG. 1, the "combustion stream" comprises the gases flowing through conduit 5, combustion chamber 7 (where combustion takes place) and conduit 8. As fuel is added to the first part of the compressed feed air upstream of the combustion chamber, it becomes part of the "combustion stream" as defined herein. Fuel is fed into the first part of the compressed feed air stream, i.e. the combustion stream, by conduit 6. This fuel may comprise any clean burning combustible fluid material, as for example, oil or gas mixture including a combustible such as methane or carbon monoxide. Sufficient air is introduced through conduit 5 to ensure complete oxidation of the fuel; typically a 20–30 percent stoichiometric excess of air is used for this purpose. The combustion stream then flows to combustion zone 7 where the mixture is ignited to raise the temperature of said combustion stream. Ignition takes place at ignition pressure of at least 80 psia. Conduit 8 then conducts the hot combustion stream into power turbine 9 where the hot combustion stream is expanded to produce external work. The expanded gas then leaves power turbine 9 by conduit 10.

Compressed waste nitrogen, i.e. nitrogen-rich gas which is not to be recovered as a product stream, is mixed with the combustion stream prior to its expansion in turbine 9. The waste nitrogen generation, compression and manner of mixing with the combustion stream will be described later.

Work obtained from power turbine 9 is used to drive base compressor 2, which may be directly connected to turbine 9 by shaft 11. Alternately, work may be transferred to compressor 2 by a system of gears, or turbine 9 could drive an electrical generator which supplies electrical energy to an electric motor to drive compressor 2. Any means of transferring work from turbine 9 to compressor 2 is acceptable. The work obtained from power turbine 9 may also be used to drive waste nitrogen compressor 39 through any work transfer means, as discussed above for transferring work to base compressor 2.

Further energy may be recovered from the gases exiting power turbine 9 in conduit 10. Examples of how to recover further energy from such gases are described by Coveney, U.S. Pat. No. 3,731,495, the entire contents of which is incorporated herein by reference. Coveney also describes arrangements for constructing the combustion chamber, turbine, and compressor as one unit, which would be a useful way to implement this invention.

The second part of the compressed feed air flows by conduit 4 into heat exchanger 12 where it may be partially cooled by the waste nitrogen leaving the air separation system. This air may be further cooled in a water-cooled heat exchanger, not shown. The partially cooled air then enters the air-separation system by conduit 13, where it is cooled by outgoing products in reversing heat exchange 14.

This is a preferred method of cooling and simultaneously removing impurities from air fed to the air separation system. The feed is cooled while high boiling impurities, such as water and carbon dioxide, are desublimed and deposited onto the walls of the reversing heat exchanger. Before the solid deposit plugs the heat exchanger, the feed air stream is switched to a second passageway by valve and conduit means (not shown), and a cold stream, the contamination of which is of no consequence, such as the waste nitrogen stream, is passed through the passageway of the reversing heat exchanger containing the solid water and carbon dioxide deposits, causing these impurities to vaporize and leave the heat exchanger. Before the second passageway handling the feed air stream plugs, the feed air is diverted to the cleaned passageway and the out-going stream is used to remove impurities from the second passageway. Of course, any means for cleaning and cooling the feed streams will suffice, such as regenerative heat exchangers, gel traps, molecular sieves, external refrigeration, or combinations thereof.

The cooled feed air then flows by conduit 15 to higher-pressure rectification stage 16, where it is rectified against colder liquid to produce oxygen-enriched liquid at lower end 17 and nitrogen-rich gas at upper end 18. Upper end 18 of rectification stage 16 is in heat exchange relationship with lower end 20 of lower-pressure rectification stage 19 by conduits 21 and 22 and heat exchanger 23, a condenser-evaporator well known in the art. Nitrogen-rich gas flows via conduit 21 to heat exchanger 23, where it is condensed against colder low-purity oxygen, the formation of which will be discussed later. The condensed nitrogen-rich material is then refluxed by conduit 22 to column 16, thereby providing the colder liquid to rectify the feed air. A portion of the condensed nitrogen-rich material flows by conduit 24 to lower pressure rectification column 19. Before entering column 19, the stream is expanded to lower pressure in valve 24A. The nitrogen-rich material in conduit 24 may be cooled by outgoing material in heat exchanger 25.

The oxygen-enriched liquid that forms in lower end 17 of stage 16 is introduced to lower-pressure stage 19 by conduit 26, after being expanded to lower pressure through valve 26A. This oxygen-enriched liquid may be cooled by outgoing material in heat exchanger 32.

The lower-pressure rectification stage is operated at pressure at least 20 psi and preferably at least 30 psi lower than the ignition pressure. The feeds to lower pressure rectification stage 19 are rectified to produce low-purity oxygen liquid at lower end 20 and nitrogen-rich gas at upper end 27. The low purity oxygen is boiled against hotter nitrogen-rich material in heat exchanger 23 for upward flow through column 19. A portion of the low-purity oxygen vapor is discharged by conduit 28, used to cool incoming feed air in heat exchanger 14, and discharged from the system by conduit 29 as a product stream. A product stream of nitrogen-rich gas may be discharged from upper end 27 of stage 19 by conduit 30. This nitrogen-rich product stream, which can also be used to cool incoming products in heat exchanger 14 is discharged from the system by conduit 31. If desirable, a product stream of nitrogen-rich gas may be withdrawn from conduit 21 by conduit 30A, used to cool incoming air in heat exchanger 14, and discharged from the system by conduit 31A. Of course, it is possible to operate the system without producing any nitrogen-rich product streams, i.e. all the nitrogen-rich gas may be mixed with the first part of the feed air and expanded in power turbine 9.

A stream of nitrogen-rich waste gas is discharged from upper end 27 of lower pressure rectification column 19 by conduit 25A. This stream may be used to cool the nitrogen-rich material flowing to column 19 in heat exchanger 25. This stream may also cool oxygen-enriched liquid flowing to column 17 in heat exchanger 32. The waste nitrogen-rich stream flows to heat exchanger 32 by conduit 33. Conduit 34 then conducts the waste nitrogen-rich gas to heat exchanger 14 for cooling the incoming feed air.

A portion of the incoming feed air may be diverted from conduit 15 by conduit 35, and be partially reheated in exchanger 14. This air is then work expanded in turbine T to produce extra refrigeration and introduced to lower pressure stage 19 for rectification therein by conduit 36.

It should be emphasized that the details of air-separation system A, shown enclosed by dotted lines in FIG. 1, form no part of this invention. While the air-separation system of FIG. 1 is a preferred embodiment, other embodiments of the double-column air separation system will also suffice.

The waste nitrogen leaving heat exchanger 14 in conduit 37 enters compressor 39 where it is compressed to a pressure of at least 85 psia, and preferably to between 100 and 250 psia. This waste nitrogen compression step, the key step in the invention, allows the combustion pressure and the turbine inlet pressure to be at least 20 psi higher than that of the low pressure rectification column, thereby permitting turbine 9 to operate 20 psi closer to its optimum pressure. Preferably, the operating conditions will be such that either the turbine inlet pressure or higher pressure stage operating pressure will be at its optimum. Other embodiments permit optimizing of both pressures, as will be explained later.

The waste nitrogen leaving compressor 39 may be used to cool incoming air in heat exchanger 12 prior to flowing by conduit 40 into the combustion stream. The compressed waste nitrogen may enter the combustion stream upstream of combustion chamber 7, as represented by conduit 40 in FIG. 1. Alternately, the compressed waste nitrogen may enter the combustion stream downstream of the combustion chamber, i.e. after combustion has taken place. This alternate arrangement is represented by dotted conduit 40A in FIG. 1. A quenching chamber 40B may be provided downstream of combustion chamber 7. Quenching chamber 40B provides a space for the compressed nitrogen to mix with and cool the gases leaving the combustion chamber.

Whether the compressed waste nitrogen enters the combustion stream upstream or downstream of combustion chamber 7 is the system designer's choice. If the waste nitrogen is introduced upstream of combustion chamber 7, in conduit 40, then the diluting effect on the combustion makes it less likely that the maximum allowable temperature of the walls of chamber 7 will be exceeded. On the other hand, this dilution of the oxygen and fuel prior to combustion will make the combustion less efficient. Introducing the waste nitrogen downstream of combustion chamber 7 through conduit 40A, provides a more efficient combustion process, but with higher likelihood of generating excessively high temperatures in the combustion chamber. Of course, the compressed waste nitrogen could be split, with a portion entering the combustion stream through conduit 40, and the remainder entering downstream of chamber 7 through conduit 40A.

The combustion stream, to which the compressed nitrogen has been added, then flows by conduit 8 to turbine 9 for work expansion therein, as described previously.

Preferably, the first part of the compressed feed air, which is fed to the combustion system, will have a flow rate higher than that of the second part of the feed air, which is processed in the air separation system. It is also preferable that substantially all of the work generated in turbine 9 be used to drive compressors 2 and 39. However, if it is desired to use the system to generate additional energy for use outside the air separation system, then power turbine 9 can be built larger than necessary to merely compress the feed air and waste nitrogen. A larger air stream may be fed to the combustion system and excess shaft work from turbine 9 may be used to drive, for example, an electrical generator or other energy-requiring equipment, not shown.

Figure 2:
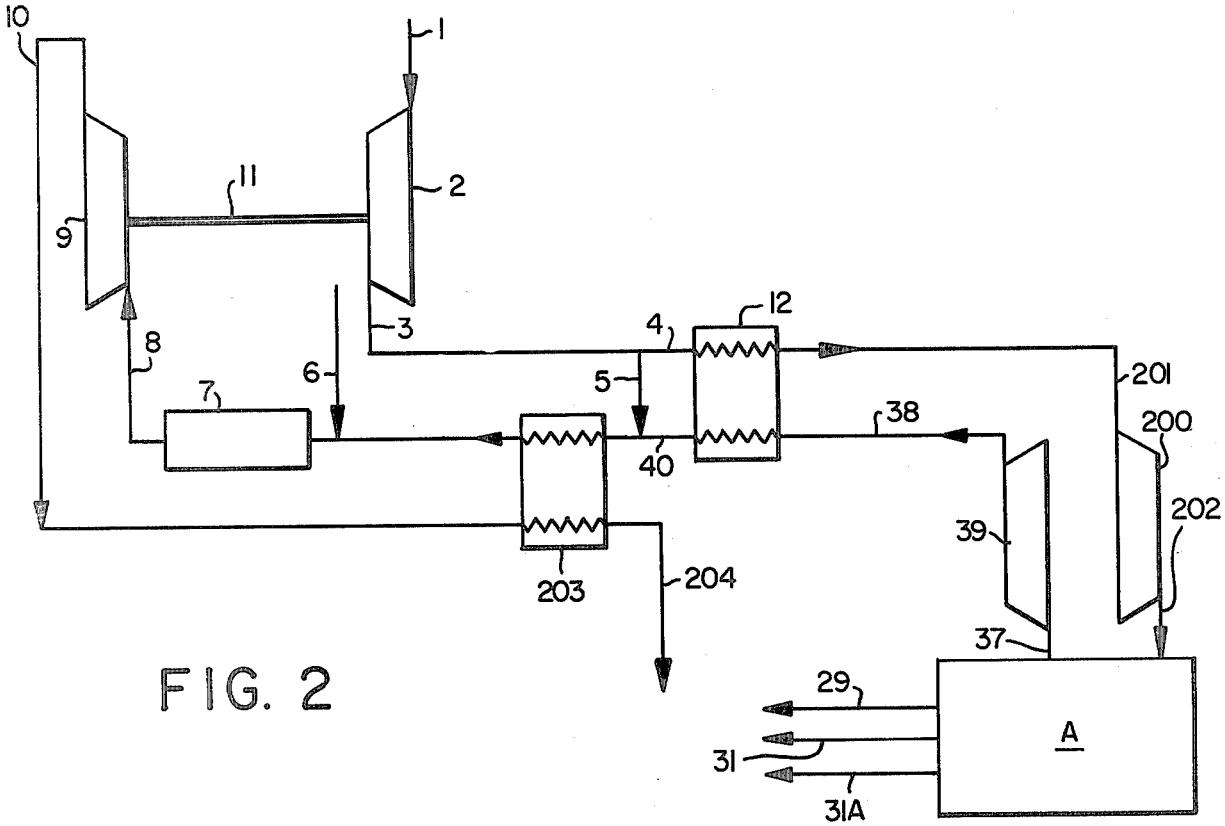
FIG. 2 is a schematic flowsheet of an embodiment of the invention wherein the air fed to the air separation system is further compressed after the first part is split off for the combustion stream.

FIG. 2 illustrates two preferred additional features that may be incorporated into a system for practicing the invention: (1) a booster compressor, 200, for further compressing the air fed to the air separation system, and (2) a heat exchanger, 203, for recovering sensible heat from the work-expanded combustion stream. These additional features may be incorporated into the system individually or, as shown in FIG. 2, in combination.

The system illustrated in FIG. 2 functions as follows. Parts whose functions are the same as in FIG. 1 have the same one- or two-digit reference numeral. Parts shown in FIG. 2 but not in FIG. 1 have three-digit reference numerals beginning with 200.

Feed air enters by conduit 1 and is compressed by compressor 2. The compressed air in conduit 3 is split into a first part in conduit 5 and a second part in conduit 4. The first part is mixed with fuel from conduit 6, and compressed waste nitrogen from conduit 40. The combustion stream is heated in heat exchanger 203 by expanded combustion gases from turbine 9. The heated combustion stream is then ignited in combustion chamber 7 and work-expanded in power turbine 9. The hot gases exiting power turbine 9 then flow by conduit 10 to heat exchanger 203, where they heat the uncombusted gases, as described previously.

The second part of the feed air may be cooled by outgoing products in heat exchanger 12, after which it may be cooled in a water-cooled exchanger, not shown.

This feed air then flows by conduit 201 into booster compressor 200 where it is further compressed to the operating pressure of the higher pressure rectification stage, preferably at least 150 psia. A water-cooled heat exchanger, not shown, cools the air leaving compressor 200, which then flows through conduit 202 into the air separation system. Work recovered from power turbine 9 may be used to drive booster 200 in the same manner as compressor 2.

Product streams of nitrogen-rich gas and low-purity oxygen are produced in the air-separation system in the same manner as illustrated in FIG. 1. These streams exit the system in conduits 29 and 31, and 31A. Waste nitrogen exits the air-separation system in conduit 37 and is compressed in compressor 39 to a pressure slightly higher than that of combustion chamber 7. The waste nitrogen may be used to cool incoming gases in heat exchanger 12.

Booster air compressor 200 is preferably employed if the optimum operating pressure of the higher-pressure stage exceeds the optimum inlet pressure of the power turbine. In such case, additional compressor 200 allows optimization of both power turbine inlet and higher-pressure stage operating pressures.

For example, suppose the optimum inlet pressure of the turbine were 120 psia, and that the optimum operating pressure of the higher pressure stage were 150 psia. In such case, compressor 2 would compress the feed air to about 120 psia, and compressor 200 would boost the pressure of the air fed to the higher-pressure column to 150 psia.

Figure 3:
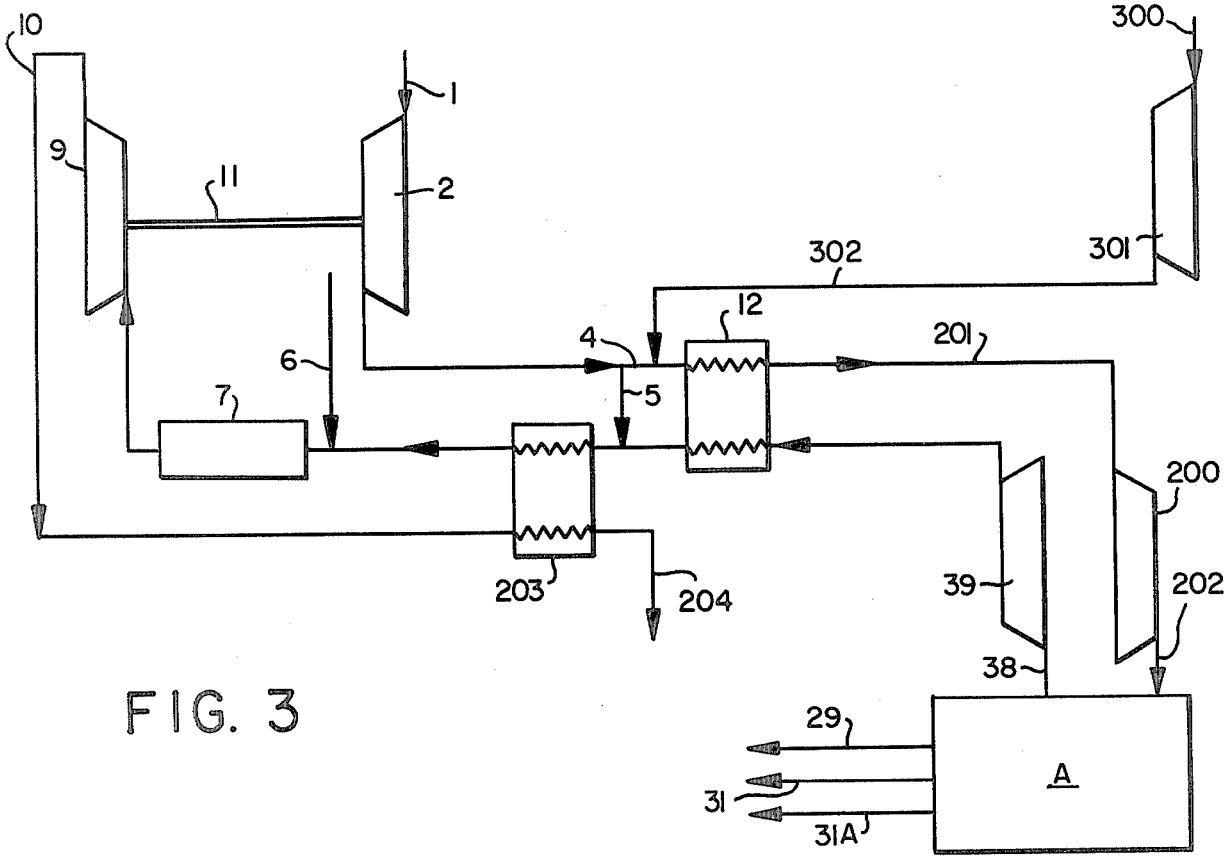
FIG. 3 is a schematic flowsheet of an embodiment of the invention wherein an additional air feed stream is supplied to the air-separation system.

FIG. 3 is the same as FIG. 2 except that auxiliary air compressor 301 has been added. The equipment illustrated in FIG. 3 functions exactly as that of FIG. 2, except for additional parts 300, 301 and 302. A supplemental stream of feed air enters auxiliary compressor 301 by conduit 300. Compressor 301 compresses the additional feed stream to the same pressure as that of stream 4. The additional feed stream then flows by conduit 302 into conduit 4. The compressed air in stream 4 is then further processed as described previously and shown in FIG. 2.

Many currently-available power systems are designed to operate with the mass flow rate of the gases expanded in power turbine 9 substantially equal to that of the gases compressed in compressor 2. Auxiliary compressor 301 allows such operation of these power systems, when the mass flow rate of the air compressed in auxiliary compressor 301 equals that of the product streams removed from the air separation system by conduits 29, 31 and 31A. Operation in this manner causes both power turbine 9 and compressor 2 to have the same inlet mass flow rates.

Figure 4:
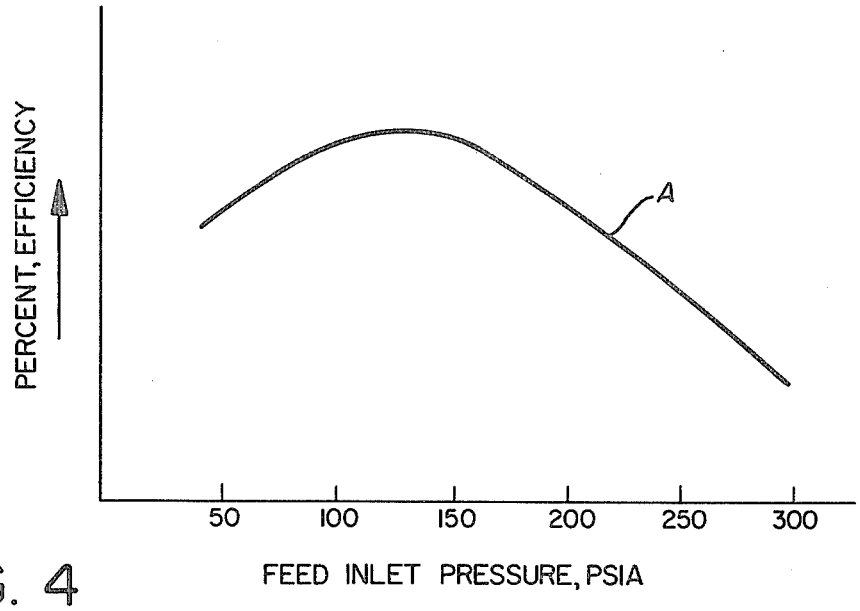
FIG. 4 shows a typical efficiency curve for power turbines.

FIG. 4 is a graphical representation of efficiency of a typical power turbine. It can be seen from curve A of FIG. 4 that this power turbine has an optimum inlet pressure of about 120 psia. While efficiency curve A may shift to the left or right of FIG. 4 for various inlet turbine temperatures and for different turbines, the curve will always be shaped like curve A. That is, there will always be an optimum inlet pressure for a given turbine operating at given conditions.

Figure 5:
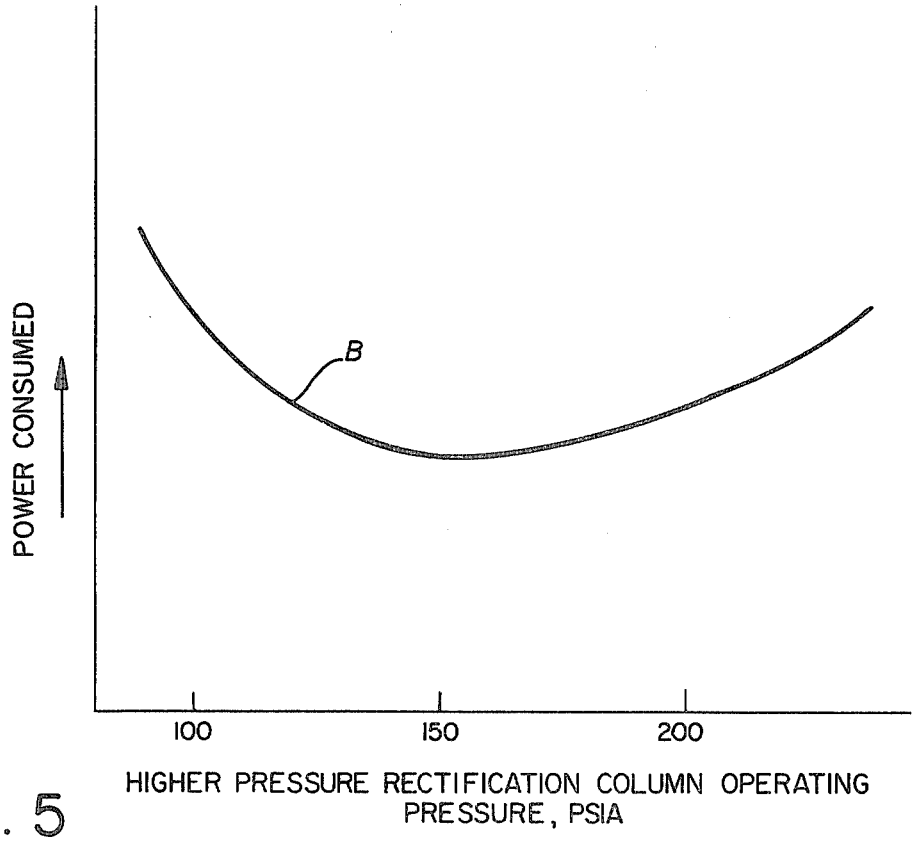
FIG. 5 shows energy requirements for typical double-column air separation plants.

FIG. 5 shows schematically power consumption versus higher-pressure stage operating pressure for a typical double-column air-separation plant. Curve B will shift for different distillation systems and operating conditions, but there will always be an optimum operating pressure for a given air-separation plant operating at a given set of conditions.

It can be seen from curve B of FIG. 5 that based solely on power considerations the optimum higher-pressure column operating pressure for a typical air-separation plant is about 150 psia. Since waste nitrogen is discharged from the lower-pressure column, which is normally operated at 1/5 to $\frac{1}{3}$ the pressure of the higher pressure column, it is readily apparent that the optimum discharge pressure of waste nitrogen is about 30 to 50 psia. However, as can be seen from FIG. 4, operating the turbine with inlet pressure of 30 to 50 psia would be very inefficient. Practice of the present invention by compressing the waste nitrogen stream prior to its introduction to the combustion stream allows either or both the air-separation system and power turbine to operate closer to their respective optimum pressures. The energy requirements of the extra compression step, although said step is performed in friction producing machinery at less than 100 percent efficiency, is more than compensated for by operating the air-separation system and/or power turbine closer to their optimum pressures. This will be illustrated by the following examples.

EXAMPLE I

Assume it is desired to produce 2000 tons/day of low-purity oxygen having an oxygen content of 98 percent and 300,000 n $ft^3$/hr of nitrogen-rich gas having a purity of 99.85 percent.

TABLE I-A

| Conduit No. | Flow Rate ($Nft^3/hr \times 10^{-3}$ | Temperature (°K) | Pressure (psia) | Oxygen Content (mole %) |
|---|---|---|---|---|
| 1 | 25879 | 320 | 14.7 | 21 |
| 3 | 25879 | 670 | 150 | 21 |
| 4 | 10380 | 670 | 150 | 21 |
| 5 | 15499 | 670 | 150 | 21 |
| 29 | 2068 | 317 | 35 | 98.0 |
| 31 | 0 | — | — | — |
| 31A | 300 | 317 | 140 | 0.15 |
| 37 | 8012 | 317 | 35 | 2. |
| 40 | 8012 | 640 | 150 | 2. |
| 8 | 23511* | 1100 | 150 | — |
| 10 | 23511* | 650 | 15 | — |

*Not including fuel.

The low-purity oxygen product is to be delivered at a pressure of 35 psia. The apparatus of FIG. 1 is to be operated at the conditions shown in Table I-A. Compressors 2 and 39 are both driven by work recovered in power turbine 9. The fuel requirements will be those shown in Table I-B. It can be seen that the system of the present invention requires fuel supplying $341 \times 10^6$ BTU/hr.

TABLE 1-B

| Summary for Present Invention Example I | |
|---|---|
| Higher Pressure Column operating pressure, psia | = 150 |
| Lower Pressure Column operating pressure, psia | = 35 |
| Fuel required, BTU/hr | = $341 \times 10^6$ |

If Coveney's process as disclosed in U.S. Pat. No. 3,731,495 is practiced under similar conditions to produce the same product, the results will be as represented in Table I-C.

TABLE I-C

| Summary for Coveney U.S. Pat. No. 3,731,495 Example I | |
|---|---|
| Higher Pressure Column operating pressure, psia | = 150 |
| Lower Pressure Column operating pressure, psia | = 35 |
| Fuel required, BTU/hr | = $364 \times 10^6$ |

As shown in Table I-C, operating of Coveney's process at these pressures requires fuel supplying $364 \times 10^6$ BTU/hr compared with $341 \times 10^6$ BTU/hr for the present invention. Hence, for this example, the Coveney process required 23 million extra BTU/hr or 6.7 percent more fuel than the present process. The fuel saving achievable by the present invention can be attributed to operating the power turbine at higher efficiency.

EXAMPLE II

Assume it is desired to produce 2000 tons/day of low purity oxygen having an oxygen content of 98 percent and 300,000 n $ft^3$/hr of nitrogen-rich gas having a purity of 99.85 percent. The low-purity oxygen product is to be delivered at 90 psia.

The apparatus of FIG. 2 is to be operated at the conditions shown in Table II-A, with compressors 2, 39 and 202 driven by work recovered in power turbine 9.

TABLE I-A

| Conduit No. | Flow Rate ($nft^3/hr \times 10^{-3}$ | Temperature (°K) | Pressure (psia) | Oxygen Content (mole %) |
|---|---|---|---|---|
| 1 | 24,699 | 320 | 14.7 | 21 |
| 3 | 24,699 | 625 | 120 | 21 |
| 4 | 13,348 | 625 | 120 | 21 |
| 202 | 13,348 | 320 | 300 | 21 |
| 5 | 11,351 | 625 | 120 | 21 |
| 29 | 2,068 | 317 | 90 | 98 |
| 31 | 0 | — | — | — |
| 31A | 300 | 317 | 290 | 0.15 |
| 37 | 10,980 | 317 | 90 | 7.1 |
| 40 | 10,980 | 595 | 120 | 7.1 |
| 8 | 22,331 | 1,100 | 120 | — |
| 10 | 22,331 | 681 | 16 | — |

Table II-B shows a summary of the results achieved by practicing the invention in accordance with FIG. 2 and TABLE II-A.

TABLE II-B

| Summary for Present Invention Example 2 | |
|---|---|
| Higher Pressure Column operating pressure, psia | = 300 |
| Lower Pressure Column operating pressure, psia | = 90 |
| Fuel required, BTU/hr | = $361 \times 10^6$ |

Table II-C shows the results attained by using the method of U.S. Pat. No. 3,731,495 (Coveney) to achieve the same production requirements of Example II.

TABLE II-C

| Summary for Coveney U.S. Pat. No. 3,731,495 Example 2 | |
|---|---|
| Higher Pressure Column operating pressure, psia | = 300 |
| Lower Pressure Column operating pressure, psia | = 90 |
| Fuel required, BTU/hr | $379 \times 10^6$ |

Operation of Coveney's process requires fuel supplying $379 \times 10^6$ BTU/hr compared with $361 \times 10^6$ BTU/hr for the present invention. Hence, even when Coveney's process is operated to deliver product at a higher pressure, as preferred by Coveney in U.S. Pat. No. 3,731,495, Coveney's process requires an extra 18 million BTU/hr or nearly 5 percent more fuel than the present invention.

It is believed that optimum operating pressure of the higher-pressure stage will usually exceed the optimum inlet pressure of the power turbine. However, if it is desired to operate the power turbine with an inlet pressure exceeding the operating pressure of the higher-pressure stage, the invention can still be practiced. FIGS. 6 and 7 are examples of how this might be accomplished. These Figures are schematic and do not show heat exchangers or details of the air separation system.

The system illustrated in FIG. 6 functions the same as that of FIG. 1, except that compressor 2 compresses the feed air to a pressure less than the inlet pressure of turbine 9. The first part of the compressed feed flows by conduit 5 to compressor 600, which boosts the pressure of the first part of the feed to approximately the inlet pressure of turbine 9. The first part of the feed air then enters the combustion system by conduit 601.

The second part of the feed air flows from compressor 2 to the air separation system by conduit 4, without undergoing further compression in compressor 600. The remaining parts illustrated in FIG. 6 function the same as the identically labeled parts of FIG. 1.

In FIG. 7, all of the feed air is compressed to about the inlet pressure of turbine 9. The first part of the compressed feed is fed to the combustion system by conduit 5. The second part of the feed air is work-expanded in turbine 700 and then fed to the air separation system by conduit 701. Of course, the expansion of the second part of the feed air could take place within the air-separation system, for example, downstream of the reversing heat exchanger, if desired. The remaining parts illustrated in FIG. 7 function the same as the identically-labeled parts of FIG. 1.

What is claimed is:

1. A process for producing low-purity oxygen by low-temperature rectification of air comprising:
   (a) compressing feed air to at least 85 psia,
   (b) dividing the compressed air into a first part and second part,
   (c) mixing said first part as oxidant for a combustion stream with fuel,
   (d) igniting said combustion stream in a combustion zone at ignition pressure of at least 80 psia to heat said combustion stream,
   (e) expanding the heated combustion stream in a power turbine to lower pressure with the production of external work,
   (f) recovering at least part of said external work as energy for said compressing of feed air,
   (g) cooling said second part of compressed air,
   (h) introducing the cooled air to a higher pressure rectification stage having its upper end in heat exchange relation with the lower end of a lower pressure rectification stage,
   (i) separating said cooled air into oxygen-enriched and nitrogen-rich liquids in said higher pressure rectification stage,
   (j) transferring at least part of said liquids from step (i) to said lower pressure rectification stage for separation into low purity oxygen and nitrogen-rich gases,
   (k) operating said lower-pressure rectification stage at pressure at least 20 psi lower than the step (d) ignition pressure,
   (l) discharging a low-purity oxygen product stream and at least one nitrogen-rich gas stream from said lower pressure rectification stage,
   (m) compressing at least part of the nitrogen-rich gas discharged in step (l) to pressure at least equal to the step (d) ignition pressure, and
   (n) flowing the compressed nitrogen-rich stream into the combustion stream, upstream of said power turbine.

2. The process of claim 1 wherein the feed air is compressed to pressure of from 100 to 250 psia, and wherein the lower pressure rectification stage is operated at pressure at least 30 psi lower than the step (d) ignition pressure.

3. The process of claim 1 wherein the flow rate of said first part of compressed air exceeds that of said second part, and substantially all of the work produced in step (e) is used for compressing the feed air and compressing the nitrogen-rich gas flowed to the combustion stream.

4. The process of claim 1 wherein at least part of said compressed nitrogen-rich stream is injected into the combustion stream after the step (d) ignition.

5. The process of claim 1 wherein said power turbine is operated substantially at its optimum inlet pressure.

6. The process of claim 1 wherein said higher pressure rectification stage is operated substantially at its optimum operating pressure.

7. The process of claim 1 wherein the second part of said feed air is further compressed prior to cooling.

8. The process of claim 7 wherein said power turbine is operated substantially at its optimum inlet pressure and said higher pressure rectification stage is operated substantially at its optimum operating pressure.

9. The process of claim 7 further comprising compressing an additional feed air stream to at least 85 psia, cooling said additional feed air stream, and feeding the cooled additional feed air stream to said higher pressure stage.

10. The process of claim 9 wherein the mass flow rate of the additional feed air stream is substantially equal to the total mass flow rate of the product streams.

11. The process of claim 1 further comprising compressing an additional feed air stream to at least 85 psia, cooling said additional feed air stream, and feeding the cooled additional feed air stream to said higher pressure stage.

12. The process of claim 11 wherein the mass flow rate of the additional feed air stream is substantially equal to the total mass flow rate of the product streams.

13. The process of claim 1 further comprising work expanding said second part of compressed feed air prior to introducing same to said higher pressure rectification stage.

14. The process of claim 1 wherein the first part of said compressed feed air is further compressed.

15. The process of claim 14 wherein said power turbine is operated substantially at its optimum inlet pressure.

16. Apparatus for producing low-purity oxygen by low temperature rectification comprising:

(a) a compressor for compressing feed air to pressure of at least 85 psia, (b) a combustion system comprising a combustion chamber, conduit means for flowing a first part of compressed feed air from compressor (a) to said combustion chamber, means for introducing fuel to said combustion chamber, and conduit means for flowing combusted gas from said combustion chamber to, (c) a turbine for expanding the combusted gas to lower pressure so as to produce external work, (d) means for transferring external work of turbine (c) to compressor (a), (e) means for cooling a second part of compressed feed air, (f) a double rectification column comprising a higher-pressure stage for operation at at least about 85 psia, a lower-pressure stage, and a heat exchanger joining the upper end of the higher-pressure stage and the lower end of the lower-pressure stage, separate conduit means for transferring oxygen-enriched and nitrogen-rich liquids from the higher-pressure stage to the lower-pressure stage, (g) conduit means for flowing the cooled second part of the compressed feed air to the higher-pressure stage for rectification therein, (h) a compressor for compressing nitrogen-rich gas to pressure of at least 85 psia, (i) conduit means for flowing nitrogen-rich gas from the lower-pressure rectification stage to compressor (h), (j) conduit means for flowing compressed nitrogen-rich gas from compressor (h) to combustion system (b), and (k) conduit means for discharging low-purity oxygen from said power-pressure rectification stage.

17. The apparatus of claim 16 further comprising means for transferring external work of turbine (c) to compressor (h).

18. The apparatus of claim 16 wherein conduit means (j) flows at least part of the compressed nitrogen-rich gas into combustion system (b) downstream of said combustion chamber.

19. The apparatus of claim 16 further comprising a booster compressor for further compressing the second part of the feed air.

20. The apparatus of claim 19 further comprising an auxiliary compressor for compressing an additional feed air stream to pressure of at least 85 psia, and conduit means for feeding said auxiliary feed air stream to said booster compressor.

21. A process for producing low-purity oxygen by low-temperature rectification of air comprising:

(a) compressing feed air to at least 85 psia, (b) dividing the compressed air into a first part and second part, (c) mixing said first part as oxidant for a combustion stream with fuel, (d) igniting said combustion stream in a combustion zone at ignition pressure of at least 80 psia to heat said combustion stream, (e) expanding the heated combustion stream in a power turbine to lower pressure with the production of external work, (f) recovering at least part of said external work as energy for said compressing of feed air, (g) cooling said second part of compressed air, (h) introducing the cooled air to a higher pressure rectification stage having its upper end in heat exchange relation with the lower end of a lower pressure rectification stage, (i) separating said cooled air into oxygen-enriched and nitrogen-rich liquid in said higher pressure rectification stage, (j) transferring at least part of said liquids from step (i) to said lower pressure rectification stage for separation into low purity oxygen and nitrogen-rich gases, (k) operating said lower-pressure rectification stage at pressure at least 20 psi lower than the step (d) ignition pressure, (l) discharging a low-purity oxygen product stream and at least one nitrogen-rich gas stream from said lower pressure rectification stage, (m) compressing at least part of the nitrogen-rich gas discharged in step (l) to pressure at least equal to the step (d) ignition pressure, and (n) injecting said compressed nitrogen-rich stream into the combustion stream prior to the step (d) ignition.

22. Apparatus for producing low-purity oxygen by low pressure rectification comprising:

(a) a compressor for compressing feed air to pressure of at least 85 psia, (b) a combustion system comprising a combustion chamber, conduit means for flowing a first part of compressed feed air from compressor (a) to said combustion chamber, means for introducing fuel to said combustion chamber, and conduit means for flowing combusted gas from said combustion chamber to, (c) a turbine for expanding the combusted gas to lower pressure so as to produce external work, (d) means for transferring external work of turbine (c) to compressor (a), (e) means for cooling a second part of compressed feed air, (f) a double rectification column comprising a higher-pressure stage for operation at at least about 85 psia, a lower-pressure stage, and a heat exchanger joining the upper end of the higher-pressure stage and the lower end of the lower-pressure stage, separate conduit means for transferring oxygen-enriched and nitrogen-rich liquids from the higher-pressure stage to the lower-pressure stage, (g) conduit means for flowing the cooled second part of the compressed feed air to the higher-pressure stage for rectification therein, (h) a compressor for compressing nitrogen-rich gas to pressure of at least 85 psia, (i) conduit means for flowing nitrogen-rich gas from the lower-pressure rectification stage to compressor (h), (j) conduit means for flowing at least part of the compressed nitrogen-rich gas into combustion system (b) upstream of said combustion chamber, and (k) conduit means for discharging low-purity oxygen from said lower-pressure rectification stage.

* * * * *